United States Patent [19]

Canon

[11] 4,026,053

[45] May 31, 1977

[54] AUTOMATIC ILLUMINATING CALENDAR

[76] Inventor: Carl E. Canon, 3716 36th St., San Diego, Calif. 92104

[22] Filed: Dec. 11, 1975

[21] Appl. No.: 639,792

Related U.S. Application Data

[63] Continuation-in-part of Ser. No. 500,276, Aug. 26, 1974, abandoned.

[52] U.S. Cl. ..... 40/117; 40/31

[51] Int. Cl.[2] ..... G09F 11/24

[58] Field of Search ..... 40/117, 112, 113, 31

[56] References Cited

UNITED STATES PATENTS

| | | | |
|---|---|---|---|
| 302,640 | 7/1884 | Sneider | 40/117 X |
| 2,097,148 | 10/1937 | Erlandsen | 40/32 |
| 2,170,408 | 8/1939 | Hillcourt | 40/112 |
| 2,215,552 | 9/1940 | Hostetler | 40/117 |
| 2,458,092 | 1/1949 | Morris | 40/112 |
| 2,791,850 | 5/1957 | Noble | 40/107 |
| 2,837,294 | 6/1958 | Jacobs | 40/31 |
| 2,900,749 | 8/1959 | Supper | 40/70 X |

*Primary Examiner*—John F. Pitrelli
*Assistant Examiner*—Wenceslao J. Contreras
*Attorney, Agent, or Firm*—Ralph S. Branscomb

[57] ABSTRACT

An automatic calendar is comprised of a film strip having the month dates of an entire year displayed in the sequential frames thereof, each frame also having a pictorial illustration or the like and the film strip being advanced at twenty-four hour intervals beyond a window in the front of the calendar housing and illuminated from behind so that the pictorial image and month date are projected through the window, there being additional film strips to display the name of the month and the day of the week through respective additional windows, and a fourth film strip is provided which is manually adjustable to display the year date.

4 Claims, 6 Drawing Figures

AUTOMATIC ILLUMINATING CALENDAR

BACKGROUND OF THE INVENTION

This application is a continuation-in-part of application No. 500,276, filed Aug. 26, 1974, now abandoned.

The invention is in the field of automatic calendars and particularly relates to a calendar which is accurate for an entire year and displays the month, the month date, the day of the week, and the year by projecting light through film strips having this information thereon, so that no external source of light is required to read the calendar.

Automatic calendars have been developed which are accurate for an entire year, but commonly they require an involved and expensive gearing structure or program to accommodate the irregularities involved in calendaring due to the different number of days in the month and the different week days associated with the days of the month for the various months. In addition, although it is common to provide bound paper calendars with illustrations which change by the month, there is a need for an automatic calendar of simple construction which provides the viewer with a separate, internally illuminated scene or illustration for every day of the year.

SUMMARY OF THE INVENTION

The present invention fulfills the abovementioned needs by providing an illuminating automatic calendar having a plurality of film strips contained therein which provide necessary calendar information and one of these film strips additionally provides a scene or illustration which is projected by self-contained light source and changes with every day of the year. This pictorial film strip passes the front of the calendar housing on a pair of guide rollers which are mounted on shafts which also rotate a continuous film strip having the days of the week displayed thereon, and the pictorial film strip in addition is provided at the end of each month with a lateral projection in the form of a rack which rotates the toothed end plate of a reel which causes a film strip sequentially identifying a month of the year to advance one space. A free-wheeling, manually operable fourth film strip is also included which displays the year date so that this strip may be advanced by hand at the end of each year. The main film strip having the illustrations and days of the month thereon is re-windable by means of a crank at the end of each year so that the calendar may be used perpetually without replacement.

DETAILED DESCRIPTION OF THE PREFERRED EMBODIMENT

Figure 1:
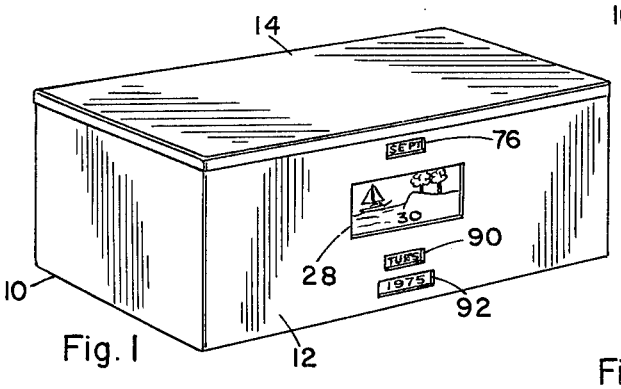
FIG. 1 is a perspective view of the calendar.
Figure 4:
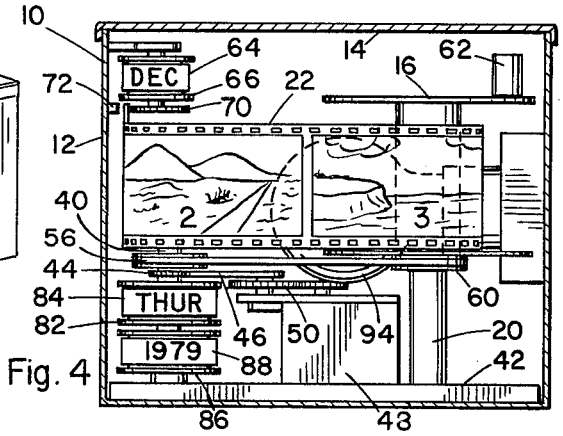
FIG. 4 is a sectional view taken on line 4—4 of FIG. 3.

The calendar is disposed within a housing 10 with several windows in the front panel 12 which will be described hereinafter, and a removeable lid 14 to enable maintenance to be performed on the calendar and permit the resetting of the device at the end of the year. Inside the housing a pair of reels 16 and 18 are journalled on vertical shafts 20 and serve the function of paying out and winding, respectively, the film strip 22 which feeds from the pay-out reel around an idler roller 24, a lead roller 26, to the take-up reel 18.

Figure 2:
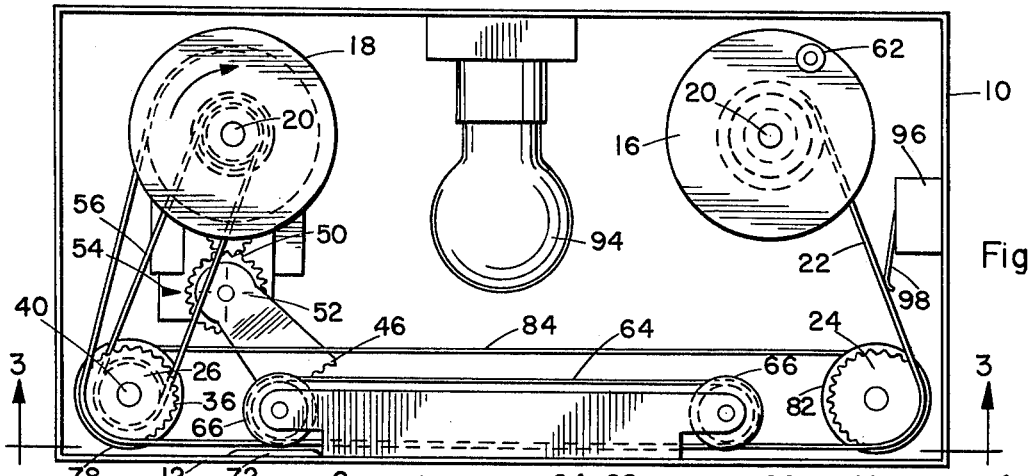
FIG. 2 is a top plan view with the top cover removed.
Figure 3:
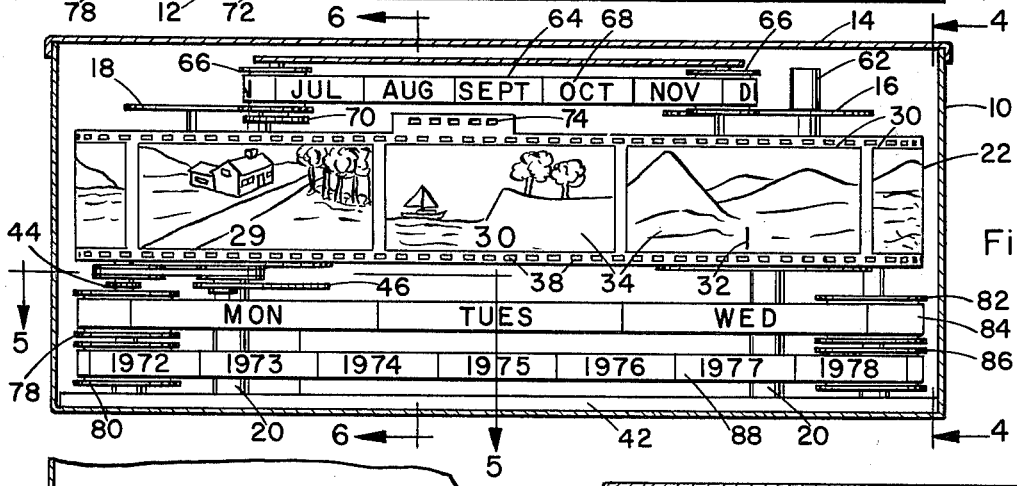
FIG. 3 is a sectional view taken on line 3—3 of FIG. 2.
Figure 5:
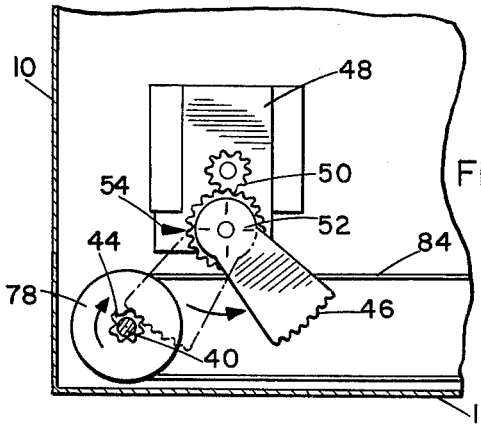
FIG. 5 is a sectional view taken on line 5—5 of FIG. 3.
Figure 6:
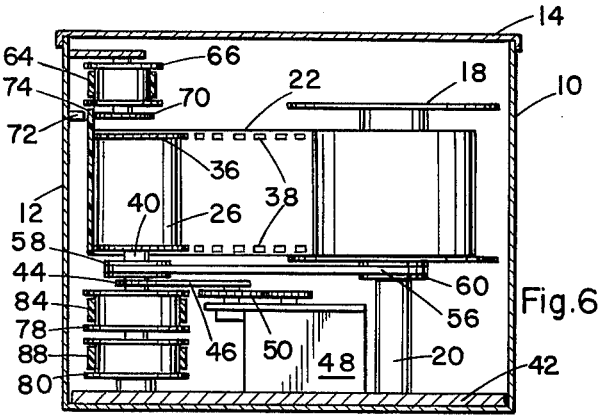
FIG. 6 is a sectional view taken on line 6—6 of FIG. 3.

It can be seen in FIGS. 2 and 3 that the lead roller 26 has two end plates 36 which are toothed and engage the marginal perforations 38 in the film strip so that positive drive is achieved. The lead roller is rigidly mounted to a shaft 40 which is in turn journalled in a base plate 42 at the bottom of the housing and could be provided with other suitable journalled supports. The lead roller has a coaxial sprocket 44 which is rotated a full 360° every twenty-four hours by means of a partial gear 46 which is driven by a clock motor 48. The gear linkage 50 between the clock and the partial gear may provide a twotone reduction so that the clock motor may be of the conventional type having a 12-hour cycle. It can thus be seen that as the motor operates, the partial gear 46 will rotate every twenty-four hours to engage the sprocket of the lead roller, thus advancing the film strip 22 one frame every day. In order that the calendar may be set prior to operation such that the day change occurs around midnight, a 24 hour clock face 52 may be displayed on the partial gear which registers with an indicator arrow 54 on the clock motor or other stationary structure adjacent the partial gear to indicate the correct time.

It can be seen that the exact digital advancing of the film strip is accomplished by the lead roller 26 as it interacts with the clock motor and partial gear, but the take-up reel 18 must be rotated at a rate which declines as more of the film is accumulated. To achieve this end, a drive belt 56 links by means of pulleys 58 and 60 the lead roller with the take-up reel, and the relative sizes of the pulleys are such that sufficient advance of the take-up reel will be effected at any time of the year. The belt 56 is slightly loose so that it will slip to some degree to prevent overdriving the take-up reel toward the end of the year. At the end of the year, the film is rewound by means of a knob or crank 62 and the calendar is set for another year. The rewind know can be also be used to return the film one frame after February 29 in leap years.

A second film strip 64 which is provided in the form of a continuous band is engaged on spaced rollers 66 which are shown as being mounted to the front panel 12 of the housing although clearly these rollers could be attached to the cover 14 as well. As can be seen in FIG. 3, this belt or film has sequential frames which indicate the names of the months of a year as at 68. The rollers are free-wheeling except for a month change gear 70 which is coaxial and rigid relative to one of the rollers and is disposed adjacent a guide shoe 72. Toward the end of each month on the first film strip 22, there is provided a lateral extension of the film as indicated at 74 which is perforated to form a racklike member which passes between the guide shoe and gear 70 at the end of each month to advance the second film strip 64 one frame. This film strip passes behind a second window 76 in the front panel of the calendar housing and is advanced such that a single frame is visible at a time.

It will be recalled that the shaft 40 of the lead roller 26 rotates with that roller under the driving force of the partial gear 46, and beneath the lead roller are disposed two spools 78 and 80 which are mounted rigidly and free-wheeling on the shaft, respectively. The spool 78 is provided with its complement 82 which is mounted coaxially with the idler roller 24 and a third film strip 84 which is continuous is engaged on these two reels and divided into seven equal frames naming the days of the week in sequence. The size of the spool 78 is such that one complete advance of the film strip 22 represents a single advance of the strip 84 for obvious reasons, and although this film strip is shown as being frictionally engaged on its driving reel, a sprocket drive similar to that used for the day of the month strip could be substituted to avoid cumulative error in advancement of the week-day strip.

The free-wheeling spool 80 and another free-wheeling spool 86 support a film strip 88 which indicates successive years. This continuous belt film strip is manually adjusted at the end of each year and could accommodate any number of years within practical limits. Third and fourth windows 90 and 92, respectively, expose the day of the week and the year.

Because of the positive drive of the sprocket 44 by the partial gear, it is necessary that some means be provided to prevent the calendar from continuing to operate at the end of the year since the film strip 22 is preferably affixed to the pay-out reel. To this end a de-energizing switch 96 is mounted to the interior of the housing and includes a spring-biased projecting toggle element 98 which rides along the film strip has an aperture aligned with the toggle 98 such that the toggle will pass through the aperture, thus operating the switch 96 which is wired to deenergize the calendar. Another way of accomplishing the same thing in a somewhat different manner is to provide a few blank frames at the tail end of the film strip 22 so that in the event the owner of the calendar failed to reset it immediately at year's end, a few days leeway would be provided.

It can be seen from FIG. 1 that the month, day of the month, day of the week, and year date, in addition to the pictorial illustration, can be seen through their respective windows, and a source of illumination diagrammatically illustrated as a light bulb 94 is installed within the calendar housing to more or less equally illuminate from behind all the film strips. Thus, when viewed from the outside, the date information and the illustration are projected by a soft light similar to that encountered in a slide viewer to present a display that is not only appealing to the eye but can be seen regardless of any external light source. The simple structure of the racks 74 utilized to advance the month strip is virtually infallible, and the independent cycle of the strip 84 which is driven by the same shaft that drives the illustrated strip is foolproof.

I claim:

1. An automatic calendar comprising:

a. a housing having a front panel with a window defined therein;

b. a first film strip having consecutive frames indicating sequentially the month dates of the year and each frame including an illustration;

c. guide means holding a portion of said film strip behind said front panel adjacent said window;

d. means for automatically advancing said film strip through said guide means every twenty-four hours to expose a sequential frame of said film through said window;

e. a second window disposed in said front panel;

f. a second film strip having consecutive frames displaying in order the names of the months of the year and means mounted in said housing for supporting said second film strip adjacent said second window and permitting said second film strip to be advanced to display sequential months through said window; and g. means on said first film strip to advance said second film strip when said first film strip reaches the last day of each month displayed thereon.

2. Structure according to claim 1 wherein said guide means includes a lead roller provided with a rigid coaxially mounted spur gear, and said advancing means comprises a clock motor having a partial gear engaging and rotating said spur gear every twenty-four hours, said partial gear having indicia thereon depicting at least in part the numerals of a twenty-four hour clock face, and further including pointer means fixed in said housing and sequentially registering with said numerals as said partial gear rotates to enable the use of said calendar to initially set same.

3. Structure according to claim 1 and including an opening on the end of said first film strip representing the end of the year, and further including a switch having a toggle element biased against said first film strip such that upon said opening reaching said toggle element, same is released to trigger said switch to de-energize said calendar at the end of the year.

4. Structure according to claim 1 wherein said second film strip comprises a continuous band and said means for supporting same comprises a pair of spaced reels, at least one of said reels having a toothed sprocket coaxially mounted thereto and said means to advance said second film strip comprises a plurality of perforated racks laterally extending from said first film strip and spaced thereon to engage said toothed sprocket to rotate same at the end of every month to display the name of the next month in sequence on said second film strip.

* * * * *